US006154557A

United States Patent [19]

Montour et al.

[11] Patent Number: 6,154,557

[45] Date of Patent: Nov. 28, 2000

[54] ACOUSTIC TRANSDUCER WITH SELECTIVE DRIVING FORCE DISTRIBUTION

[75] Inventors: Michael Montour; David Alexander Todd, both of Vancouver, Canada

[73] Assignee: Sonigistix Corporation, Richmond, Canada

[21] Appl. No.: 09/082,538

[22] Filed: May 21, 1998

[51] Int. Cl.[7] ..... H04R 25/00

[52] U.S. Cl. ..... 381/431; 381/396; 381/117

[58] Field of Search ..... 381/396, 402, 381/408, 431, FOR 156, FOR 163, 116, 117, 190, 191

[56] References Cited

U.S. PATENT DOCUMENTS

| | | | |
|---|---|---|---|
| 3,674,946 | 7/1972 | Winey . | |
| 3,873,784 | 3/1975 | Doschek . | |
| 3,919,498 | 11/1975 | Beer . | |
| 3,922,503 | 11/1975 | Tabuchi . | |
| 3,939,312 | 2/1976 | McKay . | |
| 4,156,801 | 5/1979 | Whelan et al. . | |
| 4,337,379 | 6/1982 | Nakaya . | |
| 4,468,530 | 8/1984 | Torgeson | 381/402 |
| 4,471,173 | 9/1984 | Winey . | |
| 4,527,017 | 7/1985 | Kopinga et al. . | |
| 4,924,504 | 5/1990 | Burton . | |
| 5,003,609 | 3/1991 | Muraoka . | |
| 5,148,493 | 9/1992 | Bruney | 381/402 |
| 5,537,482 | 7/1996 | Janning . | |
| 5,627,903 | 5/1997 | Porrazzo et al. . | |

FOREIGN PATENT DOCUMENTS

| | | |
|---|---|---|
| 1545517 | 5/1979 | European Pat. Off. . |
| 3712212 | 10/1988 | European Pat. Off. . |
| 3715618 | 11/1988 | European Pat. Off. . |
| 52296 | 3/1982 | Japan . |
| 80999 | 5/1983 | Japan . |
| 2043003 | 9/1990 | U.S.S.R. . |

*Primary Examiner*—Stella Woo
*Assistant Examiner*—Suhan Ni
*Attorney, Agent, or Firm*—Dowell & Dowell, P.C.

[57] ABSTRACT

An acoustic transducer with partially driven area of the diaphragm such that the driving forces are asymmetric with respect to the frame axis of symmetry or angled with respect to edges of diaphragm support frame to provide uniform frequency response of the transducer. The elongate magnet sections surround portions of the diaphragm with a fringing magnetic field within which a circuit of conductor strips is positioned such that selectively excited vibration modes of the diaphragm provide a smooth frequency response.

24 Claims, 4 Drawing Sheets

Fig. 1
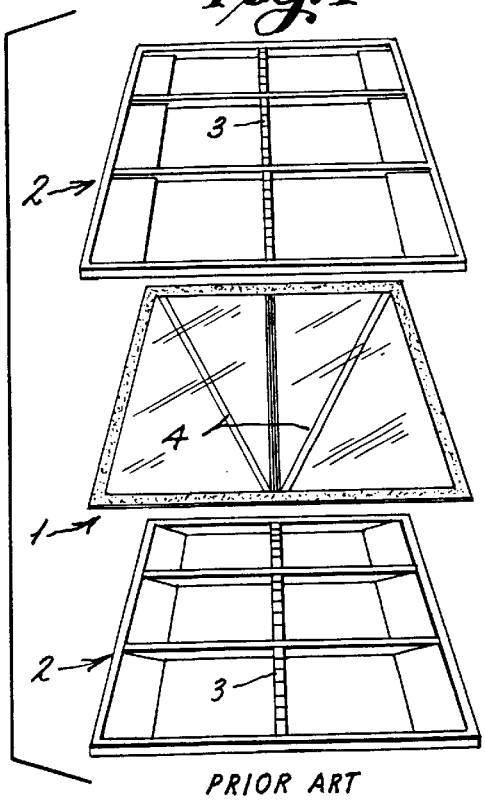
PRIOR ART
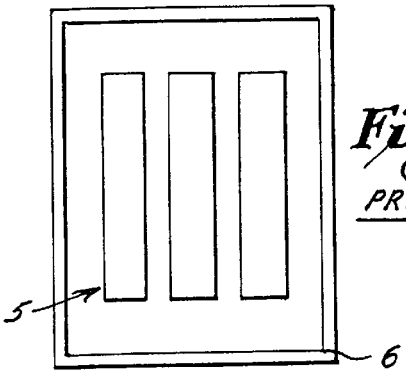
Fig. 2
PRIOR ART
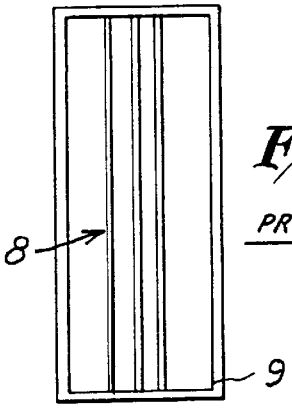
Fig. 3
PRIOR ART
Fig. 4
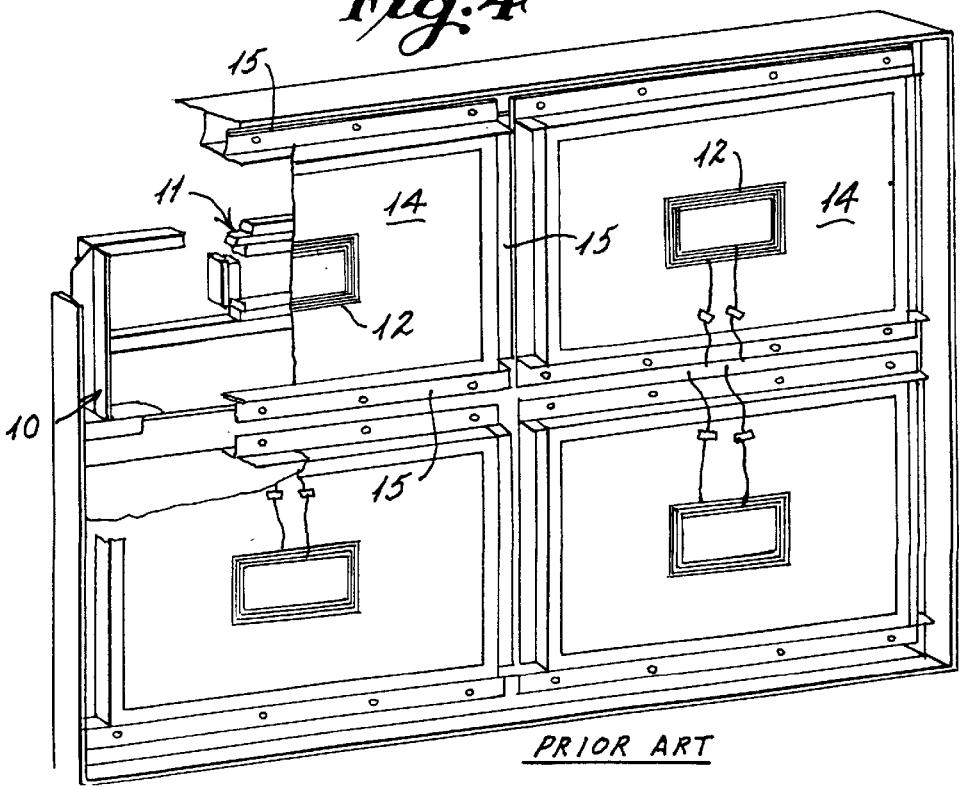
PRIOR ART 28
87
88
89
A
B
81
82
83
80
84
85
86
20
66
67
65
64
63
62
60
61
35
36
37
22
34
33
24
26
32
30
31
25
21

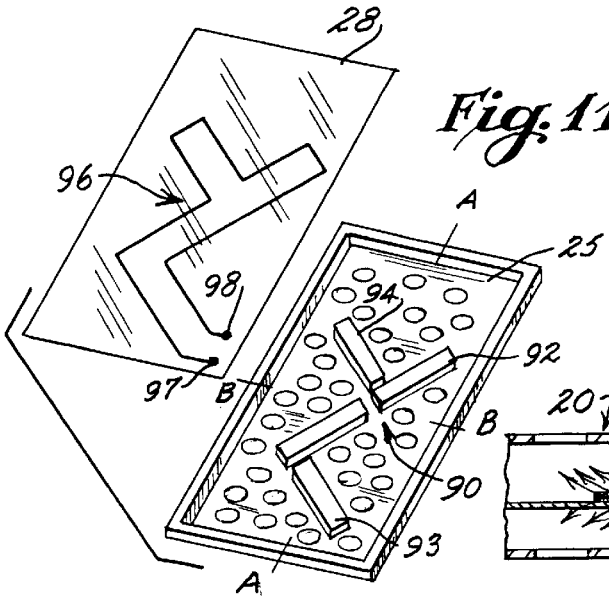
Fig. 11
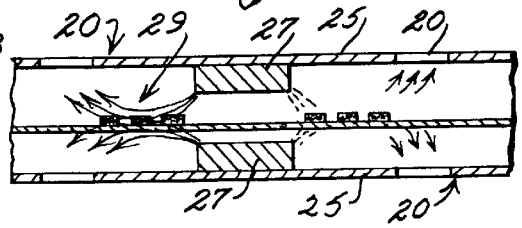
Fig. 15
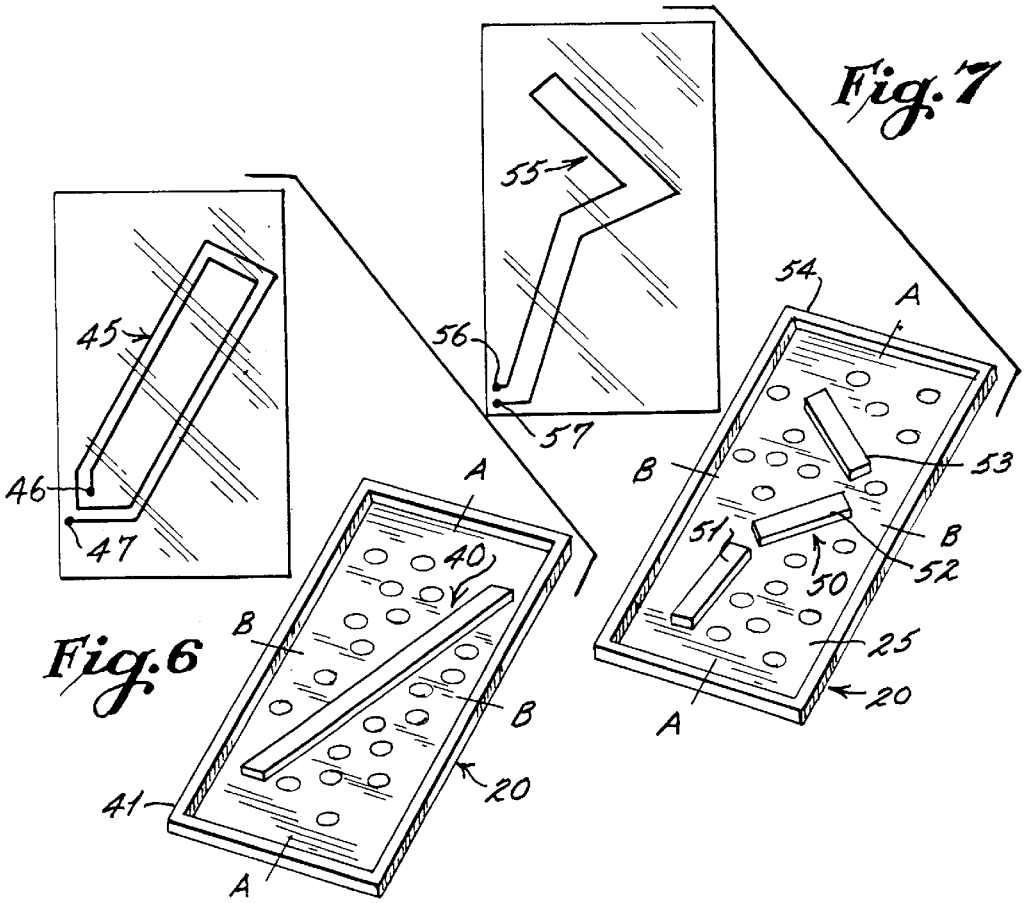
Fig. 7
Fig. 6

28
117
118
119

28
74
75
76
77
A
72
B
70
73
71
A
77
112
A
114
B
115
113
B
116
110
111
A
20

28
105
107
106
A
25
102
B
104
103
B
100
101
A 27
9
27
w

ACOUSTIC TRANSDUCER WITH SELECTIVE DRIVING FORCE DISTRIBUTION

BACKGROUND OF THE INVENTION

1. Field of the Invention

The present invention is directed to the field of acoustic transducers including planar magnetic acoustic transducers and, more particularly, to the distribution of driving forces on the diaphragm of magnetic acoustic transducers, with respect to the edges of the diaphragm which are fixed to a support frame.

2. History of the Related Art

Magnetic acoustic transducers and particularly planar magnetic loudspeakers are generally popular because of their good sound reproduction characteristics. Such loudspeakers typically include a generally flat diaphragm having a pattern of one or more conductors attached which form the "voice coil" or signal current carrying conductors. The diaphragm is positioned so that the conductors are attracted and repelled by adjacent magnets as current signals pass through the conductors, thereby causing the diaphragm to oscillate and produce sound.

The sound reproduction of a typical planar magnetic transducer is sensitive to the operating characteristics of the diaphragm. A typical diaphragm includes a thin flat polymer membrane with a pattern of thin foil-like conductors on the membrane. The conductor circuit, as described and referenced throughout this application, is the pattern of one or more conductors and equivalent terms are conductor voice coil or conductor pattern. Generally elongate portions of the conductor circuit are referred to as conductor runs and equivalent terms are conductor segments or strips. To obtain optimum acoustic response, the diaphragm is held under tension. The path for the electrical conductor runs on the diaphragm is generally chosen so the current flowing through the conductor induces net forces of uniform direction perpendicular to the diaphragm surface during operation of the transducer. Typically, the conductor runs have covered substantially most of the diaphragm so that the "active area" of the diaphragm was the area of the diaphragm not bound at the frame edges, occasionally referred to as the "open area". The generated forces in all of the conductor segments or runs within what is referenced as an "active area" of the diaphragm, cause the general direction of diaphragm motion to be perpendicular to the diaphragm surface.

The sound reproduction characteristics of a planar magnetic transducer are influenced by the shape of the frame, mechanical properties of the diaphragm and conductor pattern, location of the driven area and acoustic impedance from the support frame geometry. Typically the frame shape is rectangular and of such dimensions to produce a desired low frequency resonance as well as a characteristic dispersion at higher frequencies. The mechanical properties of the diaphragm including mass, stiffness, tension and damping all influence the modal behavior and hence frequency response of the transducer. At higher frequencies, the acoustic impedance of the underlying frame will modify the resonant behavior.

Planar magnetic transducers with partially driven areas have been known having magnet circuits and conductor patterns in either a line driver or an array of parallel bars. FIG. 1 shows an acoustic diaphragm 1 and frame 2 having a line driver 3 symmetrically placed in the middle of the rectangular shaped diaphragm as taught in U.S. Pat. No. 4,924,504 to Burton. Passive mass 4 is added to the rectangular diaphragm to control undesired resonant modes. The extra mass has the effect of reducing the output sensitivity.

FIG. 2 shows a three bar array of magnets 5 symmetrically placed in the center of a rectangular frame 6 as taught in U.S. Pat. No. 4,156,801 to Whelan et al. The acoustic transducer includes a diaphragm (not shown) with substantial non-driven area and baffles are provided contacting one side of the diaphragm to control undesired resonant modes of the diaphragm. Such baffles reduced the output sensitivity. An EMIM speaker product sold by Infinity has a design similar to the U.S. Patent to Whelan et al. and uses a combination of damping and stiffening of the diaphragm to control the undesired resonant modes.

FIG. 3 shows another three bar array of magnets 8 symmetrically placed in a rectangular frame 9 with a substantial non-driven area for the diaphragm (not shown) of an acoustic transducer as taught in UK Patent 1545517 to Millward. Again some form of damping such as foam contacting the diaphragm was used to control undesired resonant modes. Such dampening, however, reduces the output sensitivity.

FIG. 4 shows an acoustic transducer 10 of U.S. Pat. No. 3,873,784 to Doschek having a rectangular magnet pattern 11 and conductor layout 12 on diaphragms 14. The magnets and circuits are parallel to a support frame 15 and have reflection symmetry with the axis 16—16 of the frame.

The magnet structures and driven conductor lengths are parallel to the edges of a rectangular frame for these known examples of prior transducers with partially driven area. In addition, the transducers have reflection symmetry about both central axes of the frame. U.S. Pat. No. 3,674,946 to Winey describes a transducer with a triangular frame shape that functions to minimize transverse resonant waves by varying a transverse distance between the frame edges, however in this case the transducer diaphragm is fully driven over the open area, and conductor driving forces are parallel to one edge of the triangular frame.

SUMMARY OF THE INVENTION

The primary object of the invention is a reduction in the number and volume of magnets required to drive an magnetic acoustic transducer by selectively exciting diaphragm modes to produce a smoothed frequency response. The arrangement of the magnet circuit and conductor pattern is in one or more substantially elongate chain sections that are angled with respect to the edges of the diaphragm support frame or are asymmetric with respect to the axis of symmetry of the frame.

Transducers of the prior art have demonstrated a need for extra damping components to control undesired diaphragm modes particularly in passive non-driven diaphragm regions, including direct contact damping and addition of mass to the passive regions of the diaphragm. It is an object of the invention to eliminate the requirement for these extra components, hence reducing the complexity and cost of the transducer.

It is a further object of the invention to increase the sound output level for a given magnet volume by eliminating such direct contact damping on the diaphragm. The arrangement of magnets and conductor patterns in the invention reduce the excitation of undesirable vibration modes that contribute to large peaks and valleys in the frequency response of the transducers.

Another object of the preferred embodiment of the transducer is to further smooth the frequency response by addition of edge damping of the diaphragm to minimize in-phase reflections from the edges of the diaphragm, and non-contact air damping of the diaphragm such as with standard acoustic cloth.

The invention describes designs that provide partial driving of the diaphragm hence reducing the number of magnet components required while maintaining similar acoustic output. For the purposes of this invention description and including the claims, the area of the diaphragm directly driven by the electromechanical forces will be identified as the "driven area", and in general this will be substantially less than the total open area of the diaphragm.

The invention relates to using relatively few magnets in comparison to known transducers, hence the diaphragm has significant non-driven area, and the intrinsic resonant behavior is predominantly set by the frame shape and tension of the diaphragm, the other factors having a smaller influence. The invention relates to selective excitation of diaphragm modes by placement of the driving forces such that coupled energy is maximized in diaphragm modes that produce a more uniform frequency response characteristic with reduced notches in the frequency response. The preferred embodiment specifically relates to rectangular frame shapes as these frame shapes have been shown to produce a frequency response that is popular and well characterized, however the invention applies to a range of frame geometries.

Unlike the prior art, the invention uses a novel method of arranging the magnet array and conductor pattern on a diaphragm such that the diaphragm modes are selectively excited and fewer magnets are required for a given acoustic output. This is accomplished by arranging the magnet array or circuit and conductor pattern to be non-parallel to the edges of the diaphragm support frame, and asymmetric with respect to the major and minor axis of the frame. These arrangements of the magnets and conductor circuit do not require the use of baffles, contact damping or a rigid diaphragm and hence are novel. The invention can be enhanced by commonly known techniques such as edge damping, fabric cloths and the like, but the fundamental response is determined by the arrangements as described herein.

A primary characteristic of acoustic transducers is the sound output level and it is desirable to maximize the sound output pressure. Hence an object of the invention is to create the conductor design in a pattern that is angled with respect to the edges of the diaphragm frame, or asymmetric relative to the axis of the inner frame edges. The magnet circuit geometry may be similar to the conductor trace pattern, but the minimum requirement is that there is sufficient magnetic field such that the conductors are driven at an angle relative to the edges of the frame, or asymmetric to the symmetry axis of the frame, such that particular vibration modes of the diaphragm are excited that produce smooth output frequency response. Hence with this minimum geometry requirement for the driving forces the magnetic circuit may be of various forms or elements including linear bar magnets or curved magnet elements positioned near one another or a single piece non rectangular shape such as could be formed by molding.

The conductor pattern is positioned such that the conductor mass within the magnetic field is maximized and efficient coupling of the current to the available magnetic field is achieved. Hence the preferred embodiments can tolerate small gaps between magnets but do not have large sections or gaps with undriven conductor traces. There is a preferred maximum gap between ends of the elongate magnets beyond which efficiency of the transducer decreases substantially. An additional benefit of the elongate magnetic circuits of the invention is that the transducer is efficient using one integral circuit pattern on the diaphragm, that extends along a predetermined selective driving portion thereof. Additional circuit patterns may be added to the diaphragm to produce independent driving areas, however there is a resulting tradeoff in complexity of electrical connections and more non-driven conductor mass on the diaphragm.

BRIEF DESCRIPTION OF THE DRAWINGS

FIG. 1 is an assembly view of a prior art design of a line driver geometry in a rectangular frame;

FIG. 2 is a top plan view of a prior art diaphragm pattern showing a parallel array of conductor traces covering only the middle region of the diaphragm and parallel and symmetric to the edges thereof;

FIG. 3 is a top plan view of another prior art frame configuration showing placement of three parallel bar magnets covering only the middle region of the diaphragm and parallel and symmetric to the edges of the diaphragm support frame;

FIG. 4 is a perspective view having portions broken away of a planar magnetic transducer with a rectangular magnet and conductor pattern centered in the middle region of each diaphragm and parallel and symmetric with the edges of the diaphragm support frames;

FIG. 6 is a top perspective assembly view of a modification of the straight magnet chain array of FIG. 5 showing a different asymmetric orientation of the chain array with respect to the frame;

FIG. 7 is a top perspective assembly view of a chain array similar to FIG. 6 including three magnets oriented asymmetrically with respect to the diaphragm support frame and symmetrical axes of the frame with the magnets oriented in a zigzag configuration;

FIG. 11 is a top perspective assembly view of a linear chain driver pattern with three elongate magnet chains of varying length;

FIG. 15 is an enlarged partial cross-sectional view showing the relationship between the conductor patterns and magnet arrays of the present invention.

DESCRIPTION OF THE PREFERRED EMBODIMENT

Figures 5, 8, 10:
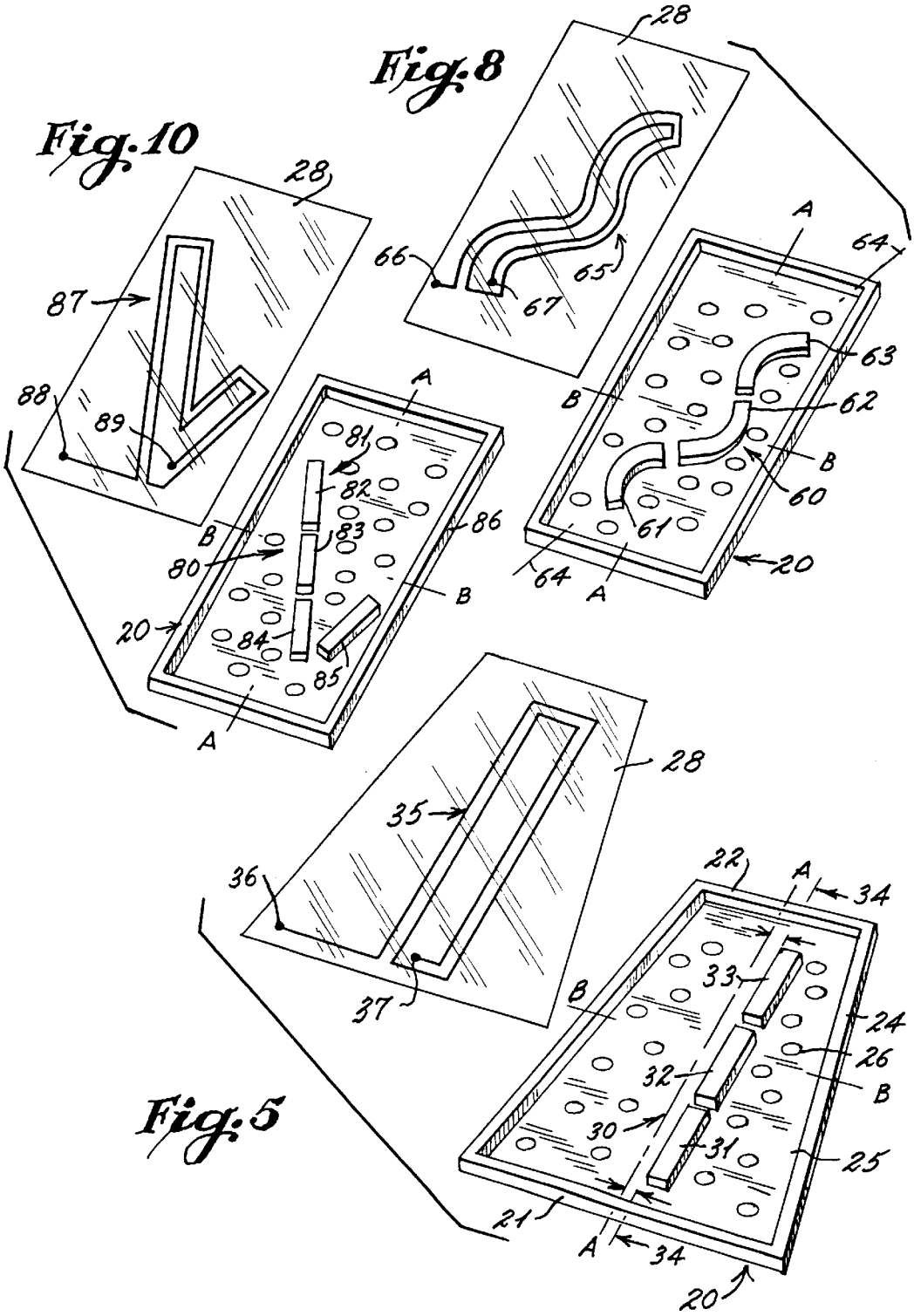
FIG. 5 is a top perspective assembly view of a magnet chain line driver showing both conductor and magnet patterns relative to the transducer frame and diaphragm in accordance with the present invention.
FIG. 8 is a top perspective assembly view of a magnet chain array showing three arcuate magnets extending asymmetrically with respect to the surrounding frame.
FIG. 10 is a top perspective assembly view of a linear chain driver pattern with two elongate magnet chains

The preferred embodiment relates to various arrays of the magnet placement and conductor patterns on diaphragms used with acoustic transducers. In the prior art, as the magnet coverage relative to the diaphragm is decreased, the magnets and conductors are maintained parallel and symmetric to the edges of the diaphragm support frames thus creating, undesirable notches and resonances in the frequency response of the transducers, requiring damping of the diaphragms. The damping of the diaphragms may result in a reduction in transducer sensitivity and also requires extra components and complexity.

It has been determined that the arrangement of magnets and conductors should be angled to the edges of the frame and asymmetric with respect to the symmetrical central axes of the frame in order to selectively excite diaphragm modes to reduce the coupling of modes that cause substantial notches in the audible region.

Each of the embodiments in the present invention will be disclosed as incorporating a transducer frame 20 defined by raised opposite end walls or edges 21 and 22 and sidewalls or edges 23 and 24. The raised edges are interconnected by a backing plate 25 having a plurality of spaced openings 26 therethrough through which sound waves are transmitted. As opposed to spaced openings, open channels may be formed in the backing plate for purposes of allowing passage of sound waves which are created by vibration of a diaphragm 28 which is secured to the side edges of the diaphragm so as to be spaced from one or more magnets which are mounted to the backing plate. The magnets are utilized to interact with an electrical circuit which is associated with the diaphragm in a manner which will be discussed in greater detail hereinafter.

The diaphragm is formed of a thin flexible polymer material, such as Mylar™ or Kapton™ approximately 1 mil thick, however other materials known in the art such as paper or fabric may be substituted with similar results. In particular materials with increased internal damping are suited.

The diaphragm support frame is preferrably ferrous to improve the magnetic circuit capability of the transducer assembly. As opposed to mounting the diaphragm directly to the frame 20, in some embodiments, although not shown in the drawings, the diaphragm may be mounted to an intermediate frame which is mounted between a pair of opposing frames such as shown at 20. It should be noted that in most embodiments, each frame 20 will be associated with an opposing frame 20 having magnets applied thereto which are supported in an array which is a mirror image of the arrays which will be described in the embodiments disclosed herein.

In the preferred embodiments, the magnets are carried by the backing plates 25 and the support frames are positioned on opposite sides of the electrical conductor traces or segments which are carried by the diaphragm with like poles of the magnets being in opposing relationship with respect to one another. In this respect, FIG. 15 is an enlarged cross-sectional view showing a diaphragm 28 having an electrical circuit pattern 29 applied thereto and wherein magnets 27 are mounted to the backing plates 25 associated with a pair of opposing frames 20. Like poles of the magnets are shown as being in opposing relationship with respect to one another on opposite sides of the diaphragm. When electrical current is supplied to the electrical circuit 29, the magnetic field created by the opposing magnets will cause a pulsation or push pull effect on the diaphragm thereby generating vibrations creating the sound waves which will be transmitted from the space between the frames and through the openings 26 in the backing plates. The field of magnetic flux is illustrated by the lines shown in the enlarged cross section. It should be noted that other arrangements of the magnets, either on one or both sides of the diaphragm, may be utilized in accordance with the teachings of the present invention. Further, the diaphragm may be mounted to an intermediate frame which is clamped and held between the frames shown at 20 in FIG. 15. However, for purposes of the description of the preferred embodiments disclosed herein, only a single frame will be described.

With particular reference to FIG. 5, a first embodiment of the present invention is disclosed. In this embodiment, a linear chain of magnets 30 is shown including permanent bar magnets 31, 32, and 33 which are aligned generally in end-to-end relationship along the backing plate 25 of the frame 20. The magnets comprising the linear chain create a line driver having a common elongated axis 34 which is angled with respect to the side edges of the frame or asymmetrical, that is, without reflection symmetry with respect to the side edges of the frame.

The frame 20 includes a symmetrical elongated central axis "A—A" and a smaller central transverse axis "B—B" each of which intersect the sidewalls of the frame at a 90° angle. The array of magnets 30 are shown as being asymmetrical not only with respect to the sidewalls of the frame but also with respect to the symmetrical axes "A—A" and "B—B" of the frame. Also as shown in FIG. 5, the diaphragm 28 is provided with an electrical circuit pattern 35 which is configured so as to generally outline the chain of magnets 30 and includes an input contact 36 and output contact 37 which are connected to appropriate electrical contacts (not shown) which will be provided on one of the frames 20 which support the diaphragm therebetween. The general offset alignment of the electrical circuit pattern 35 is shown in FIG. 15 such that the circuit generally follows the outline of the magnetic chain 30 and on either side thereof between the input 36 and output 37. In this manner, the electrical circuit extends through the field of magnetic flux created between the north and south poles of the magnets as is illustrated in FIG. 15.

The arrangement of the linear magnet chain array 30 and the electrical trace pattern 35 is such as to reduce undesirable vibration modes in the diaphragm which, in conventional acoustic transducer, contributes to large peaks and valleys in a frequency response. It has been determined that by minimizing, to a great a degree as possible, the actual driven active surface area of the diaphragm, i.e. that area to which the electrical trace pattern is applied, and by arranging the magnet array such as to be asymmetric to the edges of the frame and to the symmetrical axes thereof, a smoother output frequency response is obtained. Further, with the present invention, the mass created by the conductor pattern associated with the diaphragm is efficiently oriented within the magnetic field created by the chain of magnets 30. Therefore, unlike many prior art acoustic transducers, there is no conductor mass provided which is spaced inefficiently relative to the magnetic field created by the magnets which would adversely effect the frequency response of the diaphragm during use.

Figures 9, 12, 13, 14:
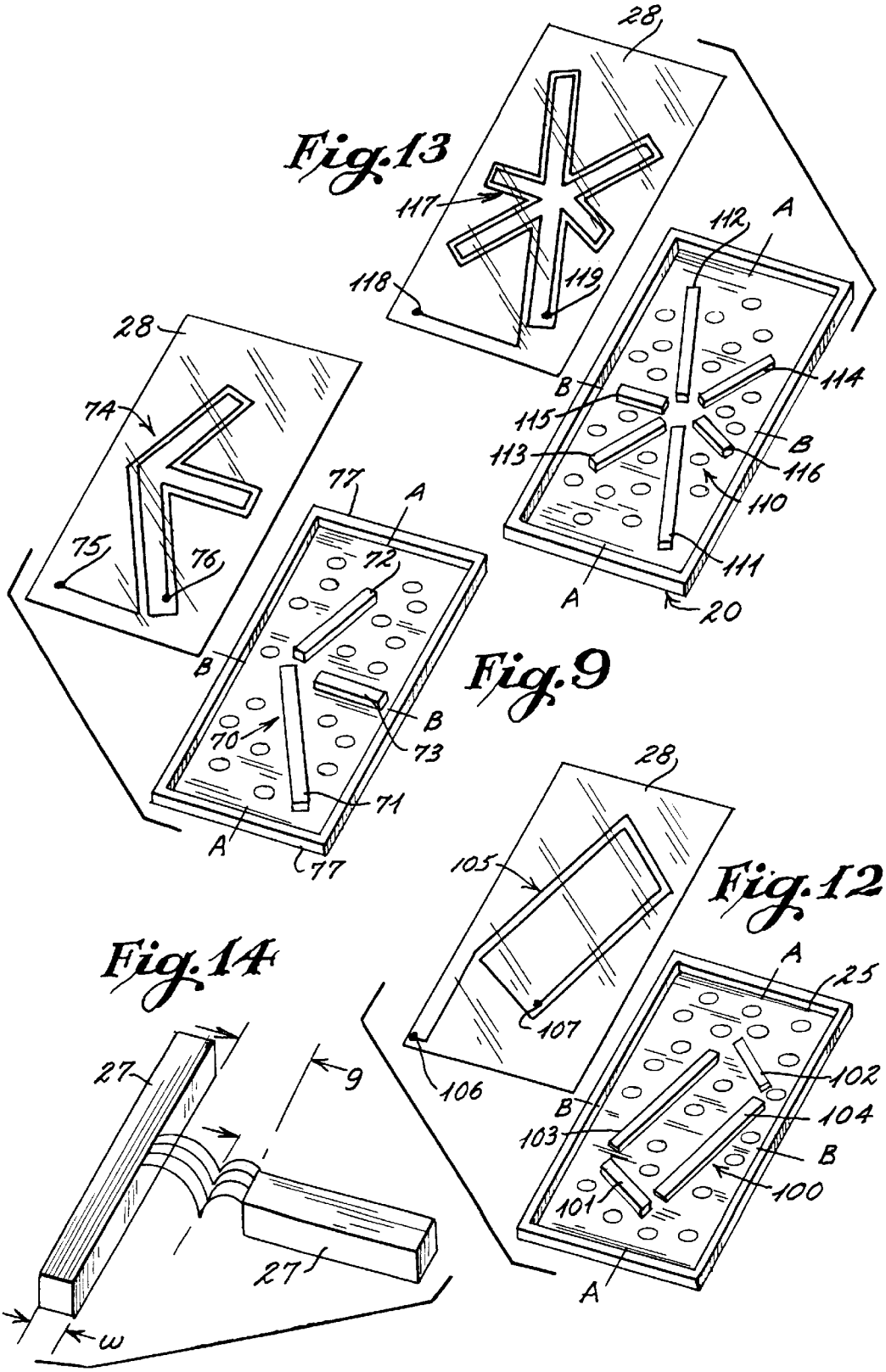
FIG. 9 is a top perspective assembly view of a linear chain driver pattern with three branches and angled and asymmetric to the frame edges.
FIG. 12 is a top view of a linear chain driver pattern with elongate magnet chains arranged as a rectangular shape with all magnets angled non-parallel with respect to the edges of the frame.
FIG. 13 is a top view of a linear chain driver pattern with elongate magnet chains arranged as a star shape with all chains angled non-parallel with respect to the edges of the frame.
FIG. 14 is an enlarged illustrational view of the linear chain driver pattern of FIG. 7 showing the maximum optimum gap between magnet chains or magnets in a chain array.

Although three planar permanent bar magnets are shown in the chain array of FIG. 5, it should be noted that two or more magnets will be normally used in the chain arrays of the present invention. Further, as described herein, a chain array refers to magnets placed in end-to-end relationship or end to side relationship. Where multiple chains are used, the magnets of different chains are preferably spaced at a gap distance "g", as shown in FIG. 14. Generally, the optimum gap distance is equal to generally not greater than twice the effective width "w" of the bar magnets. Such a gap distance will optimize the magnetic force which drive the conductors on the diaphragm and will prevent magnetic interference between the magnets of the chain arrays. The magnet chains may be open geometric arrays, as shown in FIGS. 11 or 13, or closed polygon arrays such as shown in FIG. 12.

With reference to FIG. 6, a variation of the first embodiment of the present invention is disclosed. In this variation, a linear magnet chain is shown as a single elongated magnet 40. The magnet extends along a diagonal line relative to the frame. The magnet 40 includes an elongated axis 41 which is angled or asymmetric with respect to the edges of the frame 20.

As with the embodiment of FIG. 5, the diaphragm 28 is provided with an electrical circuit pattern 45 configured to follow the general outline of the magnet 40. The electrical pattern includes an electrical input contact 46 and an output contact 47. The magnet 40 is shown as being angled relative to or asymmetrical with respect to the symmetrical axes of the frame 20.

With specific reference to FIG. 7, another variation of the embodiment disclosed in FIG. 5 is disclosed. In this embodiment, the elements in common with the embodiment shown in FIG. 5 have the same number. A magnet pattern or chain array 50 is shown as including three magnets 51, 52, and 53 which are arranged in a geometric open pattern wherein an elongated axis of each of the magnets, such as shown at 54—54 for magnet 53, is oriented asymmetrically with respect to the sidewalls or edges of the frame 20 and also asymmetrical or not parallel with respect to the primary longitudinal axis "A—A" and the minor axis "B—B" of the diaphragm 28. As with the previous embodiments, the electrical circuit pattern 55 is shown as including an input 56 and output 57 with the configuration of the pattern following the open geometric configuration defined by the magnet array 50. Again, the circuit pattern includes circuit segments which extend along the outer edges of each of the magnets in a manner as generally defined by the cross sectional view shown in FIG. 15 so as to be within the magnetic field of the magnets. As with the previous embodiments, the same smoothing of the frequency response is obtained by the asymmetrical relationship of the drive magnets and the electrical circuit pattern applied to the diaphragm with respect to the frame 20. Further, the mass created by the electrical circuit on the diaphragm is confined to the actively driven portion of the diaphragm overlying the magnet chain array 50.

With specific reference to FIG. 8, another embodiment of the invention is disclosed. In this embodiment, the chain array of magnets 60 is somewhat linear but the magnets are formed or molded so as to be arcuate in configuration. The magnets 61, 62 and 63 are shown as being oriented in end-to-end relationship about an axis 64—64 which is angled relative to or asymmetrical and not parallel to the elongated edges or sidewalls 23 and 24 of the frame 20 or to the edges or end walls 21 and 22 of the frame and are further asymmetrical with respect to the symmetrical axes "A—A" and "B—B" of the frame. The electrical conductor pattern 65 extends from an input 66 to an output 67 in a curvilinear configuration which generally outlines the magnet array 60 in a manner as previously described. The electrical conductor segments or pattern 65 is also asymmetrical with respect to the elongated axis of the frame in a manner similarly described with respect to the previous embodiments. The arrangement of the magnetic pattern and the electrical circuit of this embodiment provides a similar smooth frequency response as discussed above with respect to the previous embodiments.

FIG. 9 of the drawings shows another embodiment of the invention which incorporates a magnet chain array in an open geometric configuration. In this embodiment the array 70 includes magnets 71, 72, and 73 which are mounted to the back plate 25. Each of the magnets is of a different length with the longest magnet being shown at 71 and the shortest at 73. The magnets are spaced in end-to-end relationship with respect to one another by a predetermined gap distance. The diaphragm 28 includes an electrical circuit pattern 74 which is of a configuration to outline the three magnets creating the open geometric magnetic pattern 70 in a manner as previously described and extend from an input 75 to an output 76. It should be noted that each of the branches formed by the elongated axes of the magnets 71, 72 and 73 such as exemplified by the axis 77—77 of magnet 71, is oriented non-parallel and thus asymmetrically with respect to the edges of the frame as well as with respect to the symmetrical elongated and short axes "A—A" and "B—B" thereof. The open geometric configuration provides smooth frequency response as described with respect to the previous embodiments.

Another embodiment of the present invention is shown in FIG. 10 as including a short and long chain open geometric configuration of magnets 80 which include a linear chain 81 including magnets 82, 83, and 84 which are aligned somewhat similarly to the embodiment of the invention shown in FIG. 5. In this embodiment, however, a second short chain is formed by a single elongated magnet 85 which extends at an angle from the base of the main magnet chain 81. As with the previous embodiments, the elongated axis defined by any of the magnets, such as shown by the axes 86—86 of magnet 85, is angled and asymmetrical with respect to the side edges of the frame 20 and further asymmetrical with respect to the elongated symmetrical axes "A—A" and "B—B" of the frame. In this embodiment, the electrical circuit 87 is shown as being a somewhat "v" configuration and is designed to extend around the periphery of the elongated magnets of the chain array 80 from an input 88 to an output 89 formed on the diaphragm 28.

In FIG. 11, another embodiment of the present invention is shown including a magnet chain array 90 mounted to the backing plate 25 of the frame 20. The chain array is an open geometrical pattern including three branches defined by elongated magnets 93 and 94 which extend from a linear chain of magnets 91 and 92. The elongated axis of each of the magnets, such as exemplified by the axis 95—95 of the elongated magnet 93, are non-parallel and asymmetrical with respect to the edges of the frame and also with respect to the axes "A—A" and "B—B" of the frame. Also, the diaphragm 28 includes an electrical circuit 96 applied thereto which follows the outline of the magnet array 90 so as to be within the magnetic field of the magnets. The circuit extends from an input 97 to an output 98. As with the previous embodiments, the asymmetrical orientation of the magnets and electrical circuit as well as the concentration of mass of the electrical circuit relative to the magnets results in a smoother frequency response of the diaphragm when the transducer is use.

Another embodiment of the present invention is disclosed in FIG. 12. In this embodiment the chain array of magnets 100 secured to the backing plate 25 of the frame 20 follow a generally rectangular configuration although the magnets need not be parallel along each of the opposing edges of the chain array. As shown in the drawing, the array includes two shorter end magnets 101 and 102 which are generally not parallel with respect to one another and which are also not parallel to the edges of the frame 20 nor to the symmetrical axes "A—A" and "B—B" of the frame. The array further includes elongated magnets 103 and 104 which are also slightly offset so as not to be parallel with respect to one another and are also not parallel or symmetrical to the edges of the frame or the symmetrical axes thereof. The diaphragm 28 includes an electrical circuit 105 which extends from an input 106 to an output 107 which follows the arrangement of the magnets forming the array 100 when the diaphragm 28 is attached to the frame 20. It should be noted that the magnet chains forming geometric configurations may be mounted to the backing plate in substantially any polygonal arrangement.

A further geometric variation of the present invention is disclosed in FIG. 13. In this embodiment, the magnets are applied to the backing plate 25 as a star shaped array or pattern 110 including a pair of spaced elongated magnets 111 and 112 which are generally aligned axially with respect to one another. The array includes a second pair of magnets 113 and 114 which are also aligned axially with respect to one another and a third pair of shorter magnets 115 and 116 which are not shown as not aligned axially with respect to one another but which may be. In this embodiment, the elongated axes of the magnets 111–116 are not symmetrical or parallel to the edges of the frame or to the symmetrical axes defining the frame at "A—A" and "B—B". The embodiment further includes an electrical circuit pattern 117 which extends from an input 118 to an output 119 which is applied to the diaphragm 28 outlining the magnetic array 110.

As with the previous embodiments, although the mass associated with the circuit of the embodiments of FIGS. 12 and 13 is greater than that of the other embodiments, a benefit is obtained over conventional prior art transducers by concentrating the mass relative to the asymmetrical configuration of the permanent magnets secured to the backing plate 25 of the support frame such that an improved frequency response is obtained.

In view of the foregoing, the present invention discloses an asymmetrical arrangement for magnets associated with acoustic transducers and for providing electrical circuits on the diaphragms of the transducers which are formed so that the mass thereof is directly aligned with the magnetic fields created by the magnet chains of the transducer. Further, it is possible to incorporate the curved features of the magnets shown in FIG. 8 in other embodiments as disclosed and variations thereof.

Although the drawings have been described utilizing a frame which is rectangular in configuration, the teachings of the present invention may be utilized with substantially any polygon frame defining an opening therein for supporting a flexible diaphragm and wherein the orientation of the array of magnets is such that the elongated axis of any one of the magnets of the array is asymmetrical or non-parallel with respect to the side edges defining the polygon configuration. Therefore, the frame may have three or more side edges associated therewith.

We claim:

1. An acoustic transducer comprising, a substantially polygonal frame having inner edges defining an opening, a flexible diaphragm mounted relative to said frame so as to have a driven area disposed within said opening, at least one magnetic driver means mounted adjacent at least one side of said diaphragm so as to be spaced from said diaphragm, an electrical conductor circuit carried by said diaphragm, said electrical conductor circuit being configured so as to extend in generally opposing relationship with respect to said at least one magnetic driver means from an input to an output, and said at least one magnetic driver means being oriented at an angle which is not parallel or perpendicular with respect to said inner edges of said frame so that resulting driving forces are provided to said diaphragm are such that the distribution of the driving forces is angled transversely and without reflection symmetry relative to said inner edges of said frame.

2. The acoustic transducer of claim 1 wherein said at least one magnetic driver means is a series of permanent bar magnets which are aligned generally in end-to-end relationship.

3. The acoustic transducer of claim 2 wherein said electrical conductor circuit is configured to extend within a magnetic field created along opposite sides of said at least one magnetic driver means.

4. An acoustic transducer comprising, a substantially polygonal frame having inner edges defining an opening, a flexible diaphragm mounted relative to said frame so as to have a driven area disposed within said opening, a plurality of magnetic driver means each being a bar magnet having opposite ends and said bar magnets being arranged in at least one chain in end-to-end relationship adjacent at least one side of said diaphragm so as to be spaced from said diaphragm, an electrical conductor circuit carried by said diaphragm, said electrical conductor circuit being configured so as to extend in generally opposing relationship with respect to each of said magnetic driver means of the at least one magnet chain from an input to an output, and said at least one magnet chain being oriented at a first angle with respect to said inner edges of said frame so that resulting driving forces are provided to said diaphragm such that the distribution of the driving forces is angled transversely and without reflection symmetry relative to said inner edges of said frame.

5. The acoustic transducer of claim 4 wherein said electrical conductor circuit is configured to extend within a magnetic field created along opposite sides of each of said bar magnets of said at least one magnet chain.

6. The acoustic transducer of claim 5 including at least one magnet extending outwardly at an angle from said at least one chain.

7. The acoustic transducer of claim 6 in which said at least one magnet includes an elongated axis oriented at a second angle with respect to said side edges of said frame.

8. The acoustic transducer of claim 5 in which said at least one chain is defined having a common axis extending through said magnets.

9. The acoustic transducer of claim 5 in which said at least one chain includes each of said magnets includes an elongated axis, said elongated axes being off set with respect to one another such that said magnets are oriented in a zigzag configuration.

10. The acoustic transducer of claim 5 in which said at least one chain includes a plurality of said magnets oriented in generally end-to-end relationship in a pattern defining a polygon array having at least three sides.

11. The acoustic transducer of claim 10 in which said array is substantially rectangular.

12. The acoustic transducer of claim 5 including a plurality of chains each consisting of at least two of said magnets oriented in generally end-to-end relationship, and said chains intersecting at a common portion of said diaphragm.

13. The acoustic transducer of claim 12 wherein said plurality of chains are spaced relative to one another by a gap which is generally not greater than twice a width dimension of said magnets taken perpendicularly to an elongated axis of said magnets.

14. The acoustic transducer of claim 5 wherein said at least one chain includes at least one magnet which is substantially curved in a plane parallel to said diaphragm.

15. An acoustic transducer comprising:

a) a substantially polygon frame with at least one axis of symmetry and having an opening therein;

b) a flexible diaphragm disposed within said opening;

c) an electrical conductor means applied to at least a portion on at least one face of said diaphragm;

d) at least one magnetic driver means arranged in at least one magnet chain disposed on at least one side of said diaphragm and as to be spaced from said diaphragm; and, e) said at least one magnetic driver means oriented such that resulting magnetic driving forces are provided to said portion of said diaphragm such that a distribution of said forces is asymmetric relative to any axis of symmetry of said frame.

16. The acoustic transducer of claim 15 wherein said transducer is a planar magnetic transducer.

17. The acoustic transducer of claim 16 wherein said at least one magnet chain is a first line driver consisting of a plurality of permanent magnets each positioned asymmetricly relative to any axis of symmetry of said frame.

18. The acoustic transducer of claim 17 including a second magnet chain that is a second line driver forming a branch that extends outwardly at an angle from said first line driver, and said second line driver being asymmetric relative to any axis of symmetry of said frame.

19. The acoustic transducer of claim 16 including at least three magnet chains arranged in a pattern with at least three arms extending from a central region relative to said frame, and said at least three magnet chains are asymmetric relative to any axis of symmetry of said frame.

20. The acoustic transducer of claim 19 wherein each of said at least three magnet chains are spaced relative to one another by a gap which is generally not greater than twice a width dimension of said magnets taken perpendicularly to an elongated axis of said magnets.

21. The acoustic transducer of claim 17 wherein said at least one magnet chain includes at least one magnet which is substantially curved in a plane parallel to said diaphragm.

22. The acoustic transducer of claim 17 in which said at least one magnet chain includes a plurality of said magnets oriented in general end-to-end relationship with an elongated axis of each of said magnets being off set with respect to one another such that said magnets are oriented in a zigzag configuration.

23. The acoustic transducer of claim 17 in which said at least one magnet chain includes a plurality of said magnets oriented in generally end-to-end relationship in a pattern defining a polygon array having at least three sides.

24. The acoustic transducer of claim 17 including a plurality of magnet chains each consisting of at least two of said magnets oriented in generally end-to-end relationship, and each of said chains intersecting at a common portion of said diaphragm.

* * * * *